US005704089A

United States Patent [19]

Walters

[11] Patent Number: 5,704,089

[45] Date of Patent: Jan. 6, 1998

[54] HEATER FIN CLEANING DEVICE

[76] Inventor: Vicki R. Walters, 36 Dogwood La., Trumbull, Conn. 06611

[21] Appl. No.: 770,377

[22] Filed: Nov. 29, 1996

Related U.S. Application Data

[63] Continuation of Ser. No. 533,345, Sep. 25, 1995, abandoned, which is a continuation-in-part of Ser. No. 38,884, Mar. 29, 1993, abandoned.

[51] Int. Cl.[6] ..... B08B 11/00

[52] U.S. Cl. ..... 15/227; 15/220.3

[58] Field of Search ..... 15/210.1, 220.3, 15/227, 247, 394

[56] References Cited

U.S. PATENT DOCUMENTS 448,037 11/1891 Jacobson ..... 15/220.3

4,574,415 3/1986 Vitonis ..... 15/247 X 4,718,141 1/1988 Kuehnl ..... 15/394

*Primary Examiner*—Chris K. Moore

*Attorney, Agent, or Firm*—John H. Crozier

[57] ABSTRACT

In a preferred embodiment, a cleaning device for cleaning a finned heating element having a plurality of spaced apart parallel fins defining therebetween a plurality of channels, the device including: an elongated frame member having a handle portion for the manual grasping thereof; a plurality of parallel, spaced apart tines extending from the distal end of the frame member; a plurality of closely fitting fabric sleeves disposed over the tines; and the dimensions of the sleeved tines being such that the diameter of each sleeved tine approximates the width of the channel between adjacent the fins, and adjacent the sleeved tines are spaced apart such that they can simultaneously closely engage facing surfaces of fins defining adjacent channels of the finned heating element.

4 Claims, 6 Drawing Sheets

HEATER FIN CLEANING DEVICE

CROSS-REFERENCE TO RELATED APPLICATION

The present application is a continuation of Ser. No. 08/533,345, filed Sep. 25, 1995, now abandoned which is a continuation-in-part of Ser. No. 08/038,844, filed Mar. 29, 1993, now abandoned, and titled HEATER FIN CLEANING DEVICE AND METHOD OF USE.

BACKGROUND OF THE INVENTION

1. Field of the Invention

The present invention relates to finned heating elements generally and, more particularly, but not by way of limitation, to novel cleaning device and methods of manufacture and use, for cleaning heating elements which have a plurality of parallel fins.

2. Background Art

Finned heating elements are well known and may be found, for example, in domestic, circulating hot water baseboard heating systems. In such systems, a central tube for conveying forced circulation hot water has disposed thereon a plurality of thin, spaced apart, parallel fins oriented in planes orthogonal to the major axis of the central tube. The fins provide an extended surface area for the convective transfer of heat from the fins to the ambient air by means of the natural flow of air past the fins induced by the heating of the air. The fins are typically square or rectangular and about 1½ to 3 inches on a side.

While such heating systems are relatively satisfactory, there exists a substantial disadvantage, in that dust, dirt, smoke, and other particulate matter tend to accumulate on the surfaces of the fins and the central tube. This accumulation causes diminution of the rate of heat transfer and also presents a health hazard. The particulate matter can aggravate respiratory problems and the accumulation can harbor and serve as a breeding ground for harmful germs and fungi. Consequently, the surfaces of the fins and central tube should be periodically cleaned of accumulated matter.

A conventional method of cleaning such surfaces is by vacuuming with a brush. This method is fairly satisfactory for removing gross accumulations of particulate matter, but is not very satisfactory where the accumulated matter is relatively oily, such as is produced by tobacco smoke or cooking, for example.

Accordingly, it is a principal object of the present invention to provide a finned heater cleaning device and method that effectively remove accumulated matter.

It is a further object of the invention to provide such device and method that are simple to use.

It is an additional object of the invention to provide such a device that is economical to construct.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a cleaning device for cleaning a finned heating element having a plurality of spaced apart parallel fins defining therebetween a plurality of channels, said device comprising: an elongated frame member having a handle portion for the manual grasping thereof; a plurality of parallel, spaced apart tines extending from the distal end of said frame member; a plurality of closely fitting fabric sleeves disposed over said tines; and the dimensions of said sleeved tines being such that the diameter of each sleeved tine approximates the width of a said channel between adjacent said fins, and adjacent said sleeved tines are spaced apart such that they can simultaneously closely engage facing surfaces of fins defining adjacent channels of said finned heating element.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
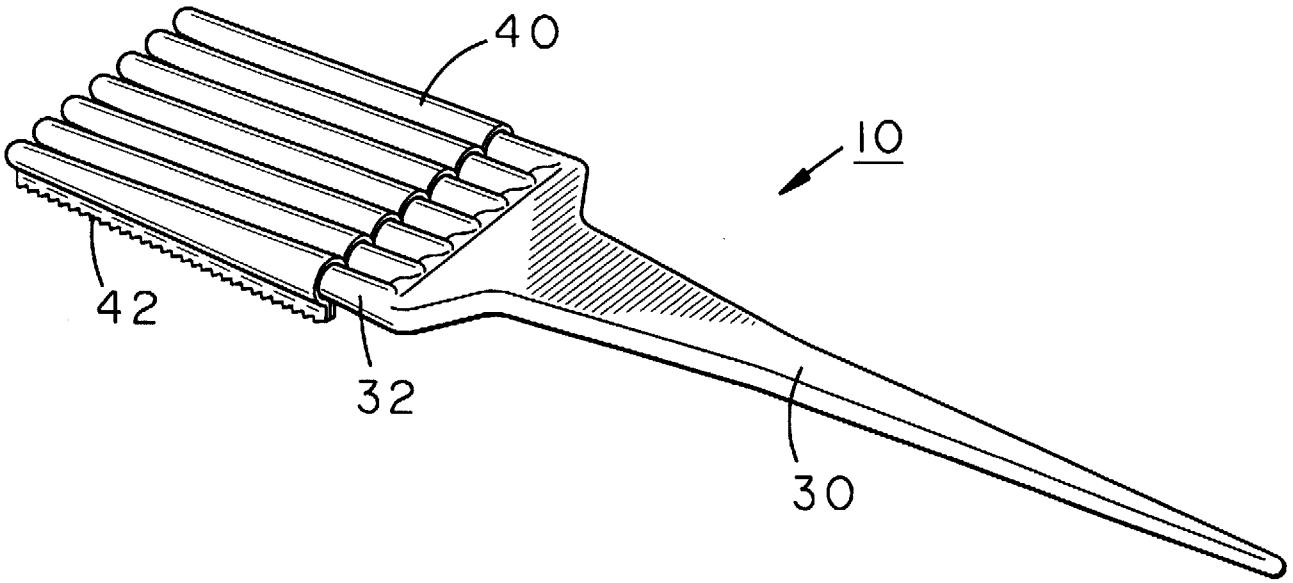
FIG. 1 is a perspective view of one embodiment of a finned heater cleaning device constructed according to the present invention.

Reference should now be made to the drawing figures, on which similar or identical elements are given consistent identifying numerals throughout the various figures thereof and on which parenthetical references to figure numbers direct the reader to the view(s) on which the element(s) being described is (are) best seen, although the element(s) may be seen also on other views.

Figure 3:
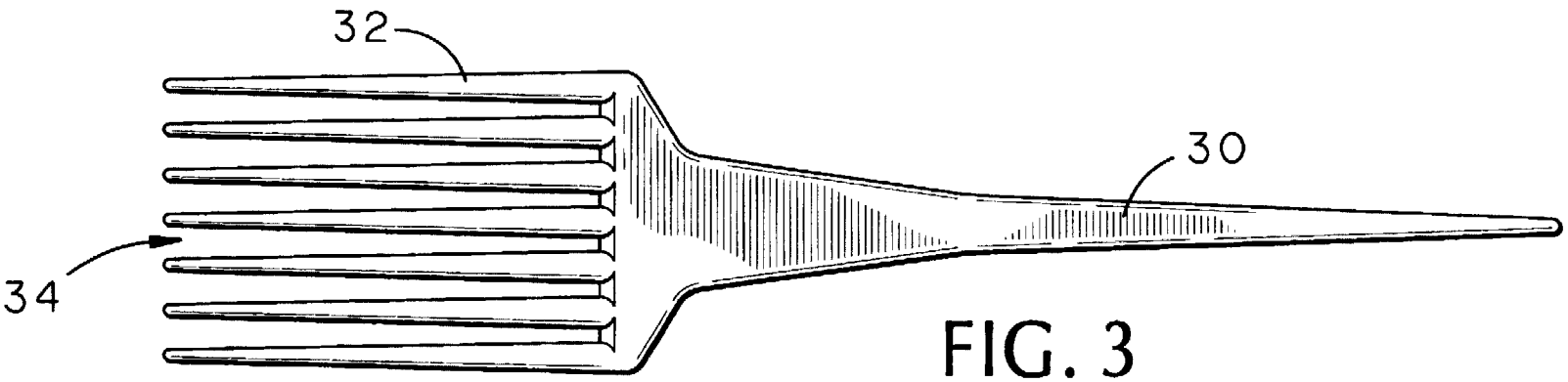
FIG. 3 is a top plan view of the frame member for the cleaning device of FIG. 1.
Figure 4:
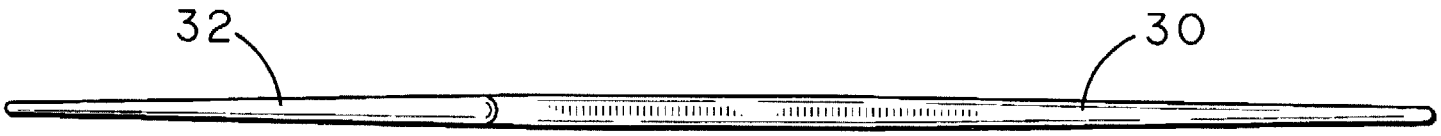
FIG. 4 is a side elevational view of the frame member of the cleaning device of FIG. 1.

Referring now primarily to FIG. 1, there is illustrated a heater fin cleaning device constructed according to one embodiment of the present invention, generally indicated by the reference numeral 10. Referring also to FIG. 3, device 10 includes a rigid or semi-rigid, generally planar, forked-shaped frame member having an elongated handle portion 30 for the manual grasping of the device. Extending from the distal end of handle 30 is a plurality of spaced apart, parallel tines, as at 32, defining therebetween a plurality of elongated spaces, as at 34. Disposed over each tine 32 is a closely fitting sleeve 40 (FIG. 1).

Figure 2:
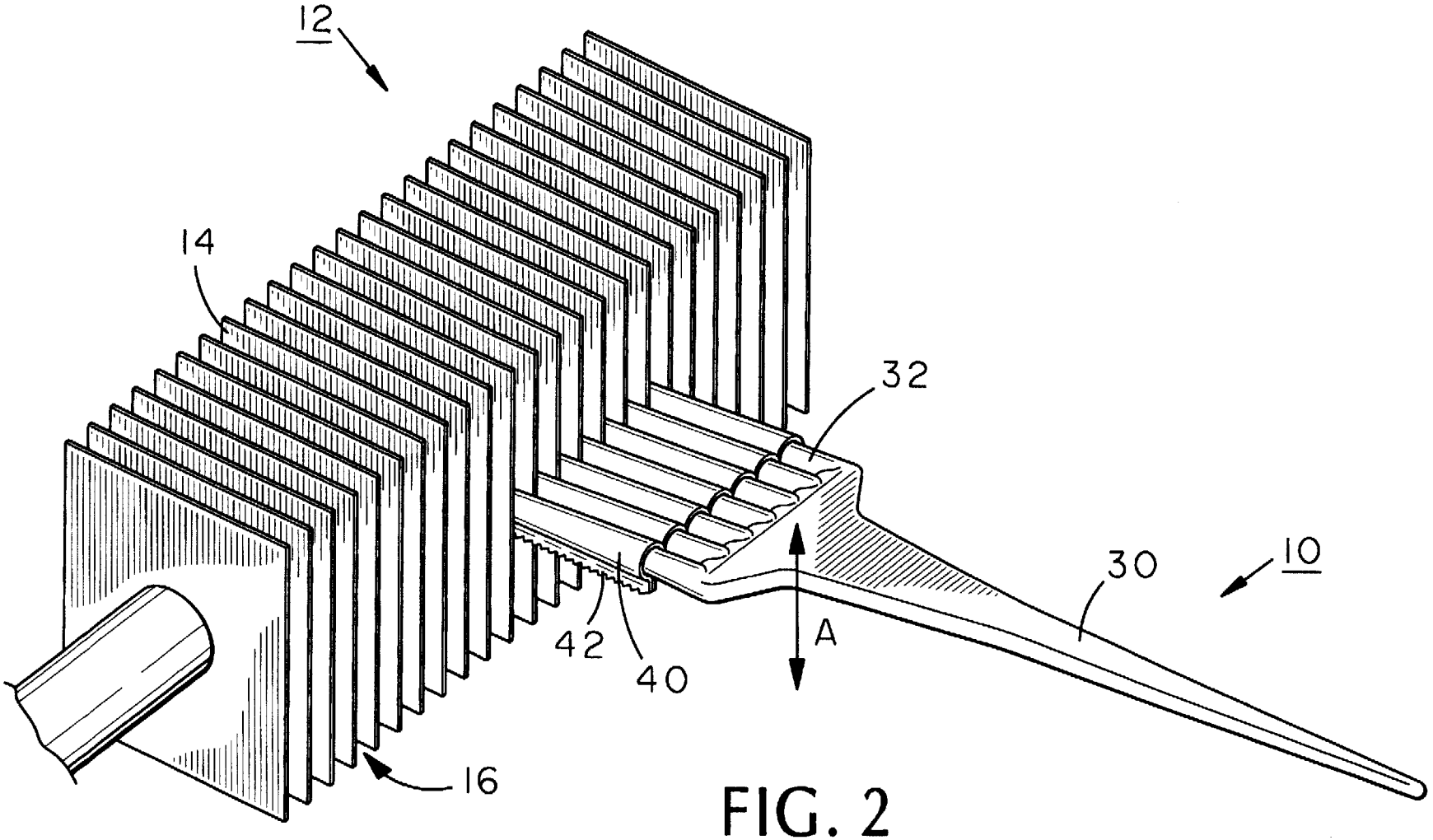
FIG. 2 is a perspective view of the finned heater cleaning device of FIG. 1 in use.

Referring now to FIG. 2, there is illustrated a finned heater element, generally indicated by the reference numeral 12, which includes a plurality of spaced apart, parallel fins, as at 14, defining between faces of adjacent fins a plurality of channels, as at 16. Fins 14 are disposed along a central tube 18 through which a heat transfer liquid, such as water, flows.

Also, shown on FIG. 2 is cleaning device 10 being used to clean the surfaces of several adjacent fins 14 and the portion of the surface therebetween of central tube 18. It will be understood that the dimensions of spaces 34 (FIG. 3) is chosen such that, when tines 32 have inserted thereon sleeves 40, the outside diameter of the sleeves approximates the width of channels 16 (FIG. 2) so as to closely engage the surfaces of fins 14. Accordingly, up-and-down movement of cleaning device 10 in the direction indicated by the double arrow "A" will partially clean the facing surfaces of adjacent fins 14, while also cleaning a portion of the surface of central tube 18. Reorientation of cleaning device 10 so that it is vertical will permit cleaning of the upper portions of facing surfaces of adjacent fins 14 and another portion of central tube 18 in a likewise manner.

Figure 5:
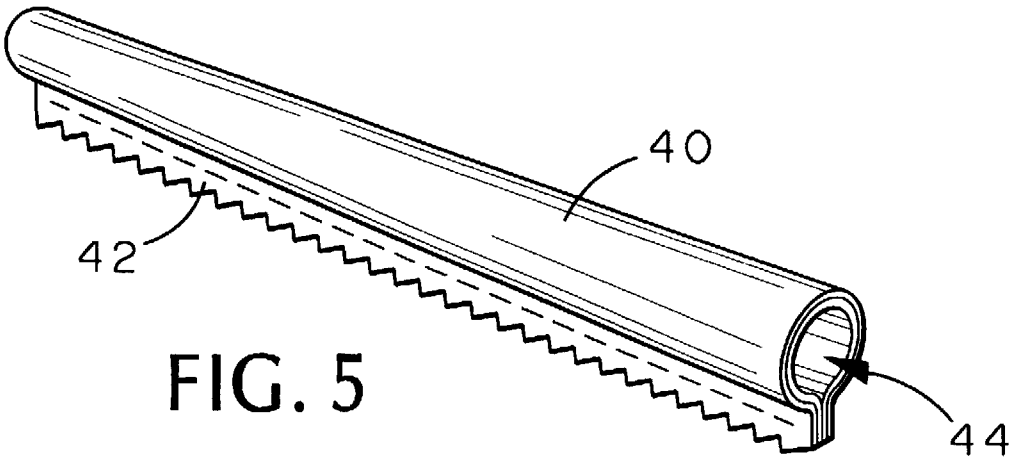
FIG. 5 is an enlarged, perspective view of a cleaning sleeve for the cleaning device of FIG. 1

Referring now to FIG. 5, it will be seen that each sleeve 40 is formed of a double layer of fabric stitched at 42 along one edge and the distal end thereof, such that the sleeve comprises a hollow tube closed at one end and open at the other. Since tines 32 (FIG. 3) are tapered, the dimensions of sleeves 40 are selected to define therein a tapered channel 44 which will closely fit over tines 32 and be frictionally secured thereon. Tines 32 and channels 44 may also have other complementary forms.

Figure 6:
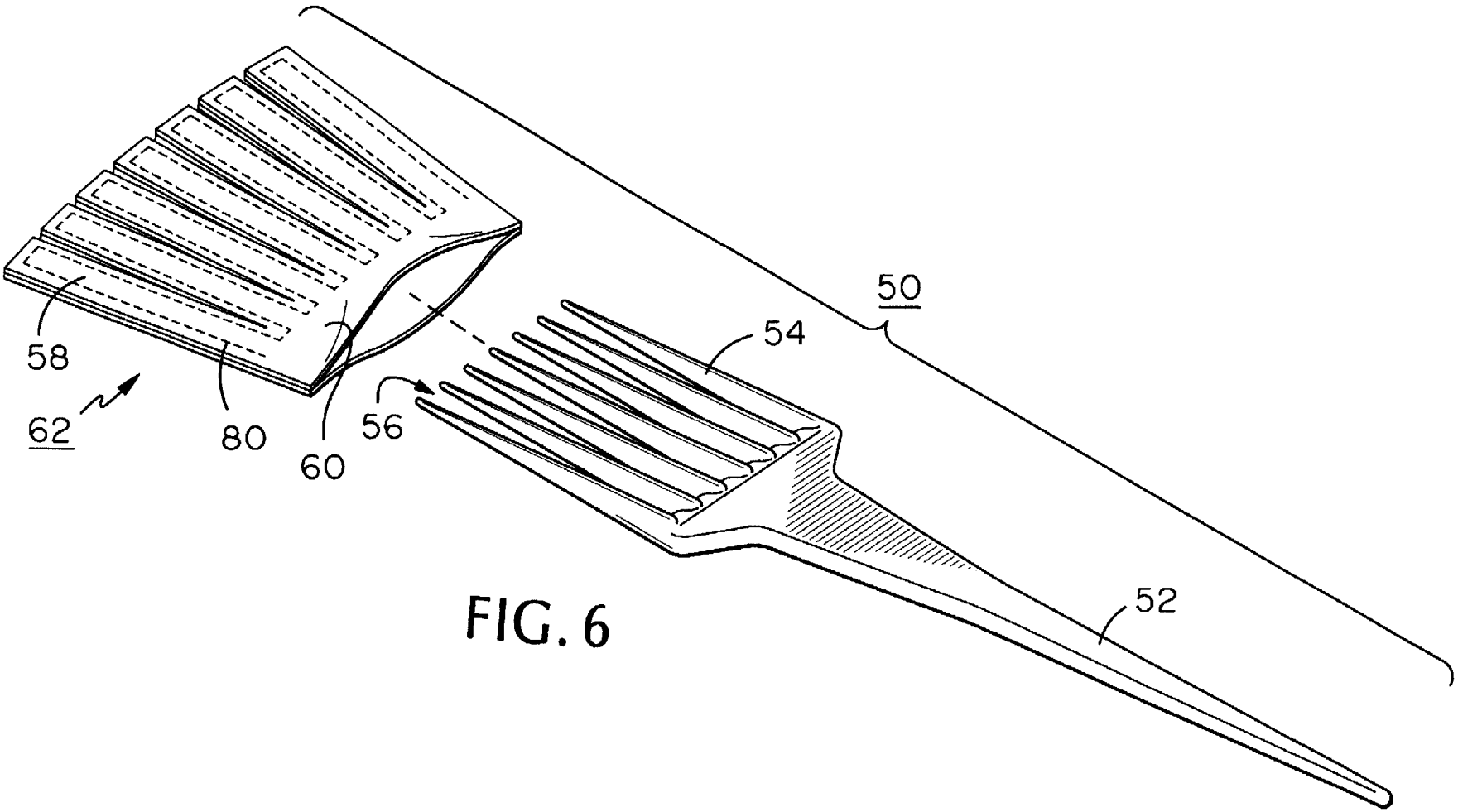
FIG. 6 is an exploded perspective view of another embodiment of a finned heater cleaning device constructed according to the present invention.
Figure 7:
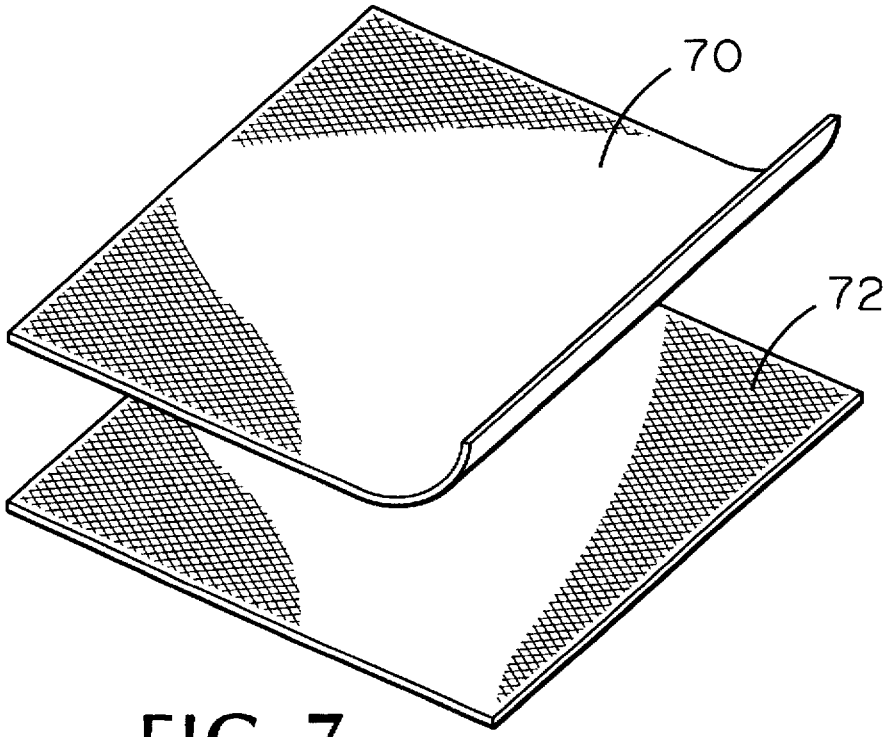
FIGS. 7–10 illustrate the steps in the manufacture of the cleaning member of the device of FIG. 6.
Figure 8:
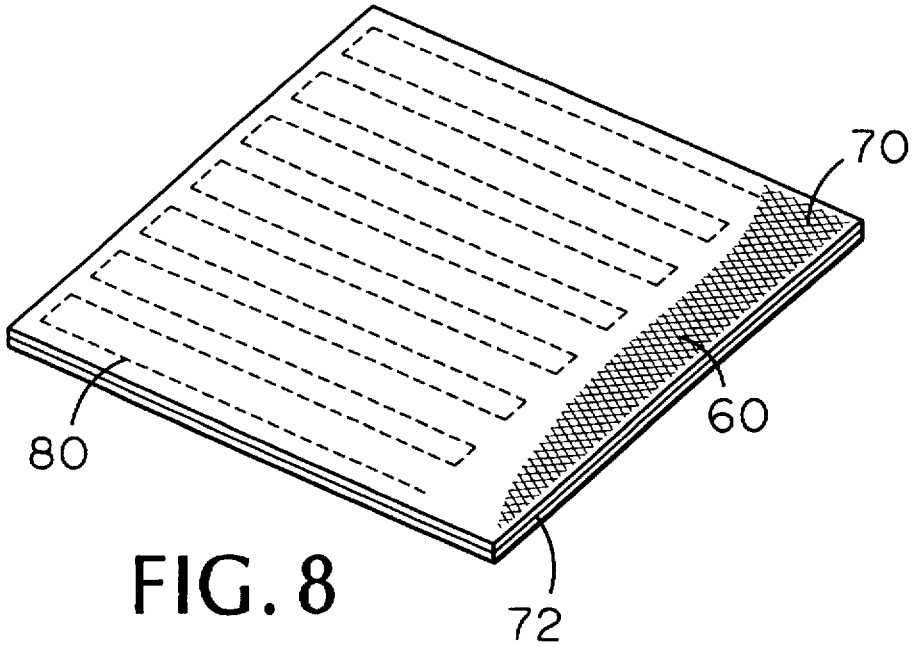
Figure 9:
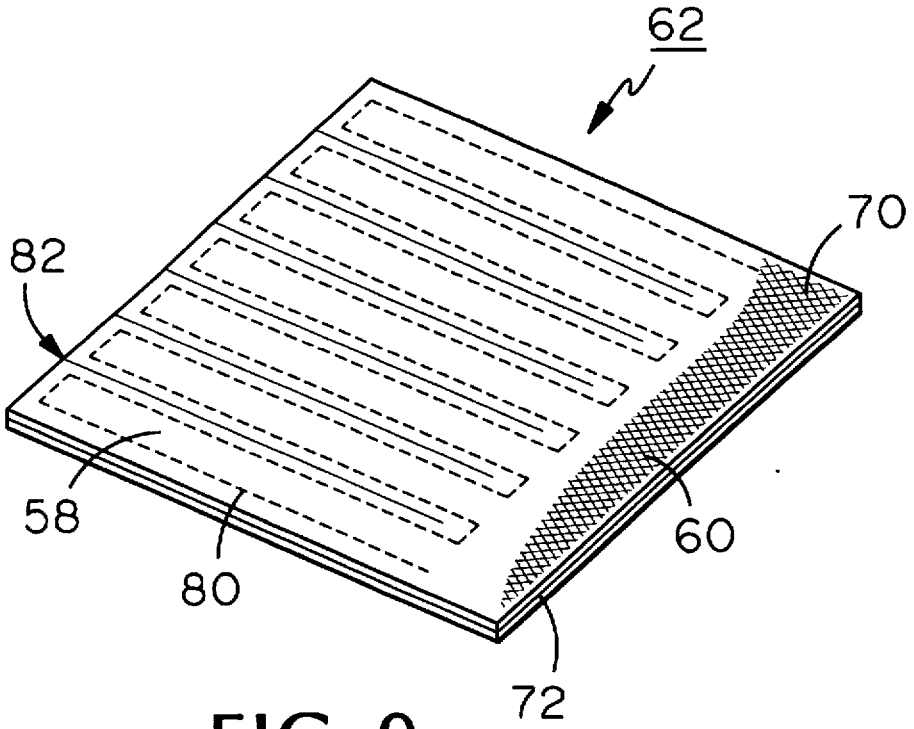
Figure 10:
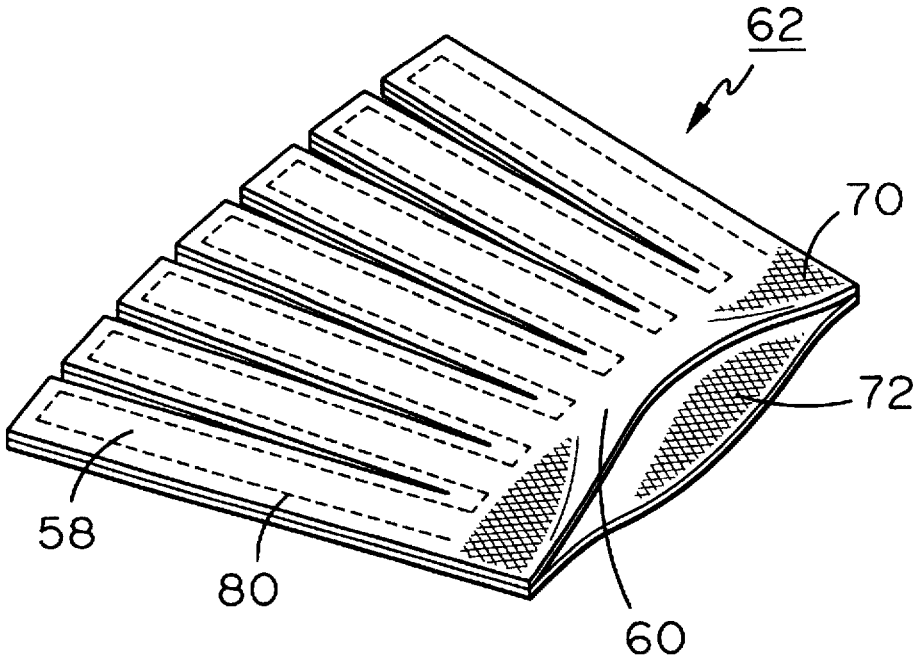

FIG. 6 illustrates a heater fin cleaning device constructed according to another embodiment of the present invention, generally indicated by the reference numeral 50. As is the case with device 10 (FIG. 1), device 50 includes a rigid or semi-rigid, generally planar, forked-shaped frame member having an elongated handle portion 52 for the manual grasping of the device. Extending from the distal end of handle 52 is a plurality of spaced apart, parallel tines, as at 54, defining therebetween a plurality of elongated spaces, as at 56. Disposed over each tine 54 is a closely fitting sleeve 58, the open ends of such sleeves being co-joined with a common skirt portion 60, and the sleeves and skirt portion together comprising a cleaning member generally indicated by the reference numeral 62.

FIGS. 7–10 illustrate steps in the manufacture of device 50 (FIG. 6). First, as shown on FIG. 7, a first sheet of fabric 70 is placed on a second sheet of fabric 72. Then, as indicated on FIG. 8, first and second sheets 70 and 72 are joined by a serpentine stiching of parallel lines 80. Next, as indicated on FIG. 9, slits, as at 82, are made between adjacent pairs of parallel lines of stitching to form cleaning member 62 with sleeves 58. Finally, as indicated on FIGS. 10 and 6, skirt portion 60 of cleaning member 62 is spread open and the cleaning member inserted over tines 54 to form cleaning device 50.

Cleaning member 62 may be constructed exactly as illustrated, or first and second sheets 70 and 72 may represent portions of much larger sheets, with individual cleaning members 62 being cut from the larger sheets after the stitching operation is completed. Die cutting may be used for severing individual cleaning members 62 and the forming of slits 82 by be accomplished in the same step. In either case, the embodiment of the present invention exemplified by cleaning device 50 can be very economically constructed.

It will be understood that cleaning device 50 will be used in the same manner as cleaning device 10 (FIG. 2) described above.

The frame members of cleaning devices 10 and 50 may be conveniently and economically formed of any suitable polymeric material by injection molding. Shown on the drawing figures is a commercially available Model #6228 Hair Lift sold by Goody Products, Inc., Kearney, N.J. Sleeves 40 and cleaning member 62 may be formed from 100% cotton wipers, about 0.01-inch thick, sold by The Texwipe Company, 650 East Crescent Avenue, Upper Saddle River, N.J.

It has been found that cleaning of fins 14 (FIG. 2) is enhanced by periodically dipping the sleeved end of cleaning device 10 (or cleaning device 50) in warm water. This removes accumulated matter and also tends to tighten sleeves 40 on tines 32 (or sleeves 58 on tines 54.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A cleaning device for cleaning a finned heating element having a plurality of spaced apart parallel fins defining therebetween a plurality of channels, said device comprising:

(a) an elongated frame member having a monolithic handle portion for the manual grasping thereof;

(b) a plurality of parallel, spaced apart tines extending from the distal end of said frame member and monolithic therewith;

(c) a plurality of closely fitting fabric sleeves disposed over said tines;

(d) the dimensions of said sleeved tines being such that the diameter of each sleeved tine approximates the width of a said channel between adjacent said fins, and adjacent said sleeved tines are spaced apart such that they simultaneously closely engage facing surfaces of fins defining adjacent channels of said finned heating element; and (e) said sleeves being co-joined by a skirt portion formed at open ends thereof.

2. A cleaning device, as defined in claim 1, wherein each said sleeve is formed from a double layer of cotton fabric.

3. A cleaning device, as defined in claim 1, wherein said frame member is formed of injection molded polymer.

4. A cleaning device, as defined in claim 1, wherein each said sleeve is provided as a separate member unattached to any other said sleeve.

* * * * *